US008763823B2

(12) United States Patent
Eaves, Jr. et al.

(10) Patent No.: US 8,763,823 B2
(45) Date of Patent: Jul. 1, 2014

(54) FOOD PAN GUIDE

(75) Inventors: Charles L. Eaves, Jr., Brighton, TN (US); Stephen P. Griffin, Atoka, TN (US); Richard A. Seiss, Arlington, TN (US); Stephen R. Willoughby, Shreveport, LA (US); Nick R. Derry, Mt. Pleasant, MI (US)

(73) Assignee: The Delfield Company LLC, Mt Pleasant, MI (US)

( * ) Notice: Subject to any disclaimer, the term of this patent is extended or adjusted under 35 U.S.C. 154(b) by 0 days.

(21) Appl. No.: 13/436,825

(22) Filed: Mar. 30, 2012

(65) Prior Publication Data

US 2012/0248957 A1 Oct. 4, 2012

Related U.S. Application Data

(60) Provisional application No. 61/469,561, filed on Mar. 30, 2011.

(51) Int. Cl.
*F25D 23/12* (2006.01)

(52) U.S. Cl.
USPC ..... 211/126.15; 312/140.3; 108/25; 62/258

(58) Field of Classification Search
USPC ..... 211/41.1, 90.01, 90.02, 103, 126.15, 211/125.3, 162, 175, 207, 208; 108/25, 26, 108/109; 312/140.1–140.4, 350; 126/33, 126/276, 332; 248/243; 62/258, 457.6
See application file for complete search history.

(56) References Cited

U.S. PATENT DOCUMENTS

| | | | | | |
|---|---|---|---|---|---|
| 754,817 | A | * | 3/1904 | Schriefer | 108/109 |
| 2,842,269 | A | | 7/1958 | Gomersall | |
| 3,124,402 | A | * | 3/1964 | Rhoads | 312/350 |
| 3,152,698 | A | * | 10/1964 | Maddox | 211/126.15 |
| 3,610,429 | A | | 10/1971 | MacKay | |
| 3,655,063 | A | * | 4/1972 | Landry | 211/41.2 |
| 3,657,776 | A | * | 4/1972 | Herbold | 220/23.8 |
| 3,688,707 | A | * | 9/1972 | White | 108/159 |
| 3,698,782 | A | * | 10/1972 | Onori | 312/350 |
| 3,874,479 | A | * | 4/1975 | Onori et al. | 186/44 |
| 3,963,125 | A | * | 6/1976 | Baggott | 211/126.15 |
| 4,802,340 | A | * | 2/1989 | Johnson | 62/229 |
| 5,355,687 | A | * | 10/1994 | Carpenter et al. | 62/258 |
| 5,363,672 | A | * | 11/1994 | Moore et al. | 62/258 |
| 5,551,774 | A | * | 9/1996 | Campbell et al. | 312/284 |
| 5,899,544 | A | * | 5/1999 | James et al. | 312/198 |
| 6,034,355 | A | | 3/2000 | Naderi et al. | |
| 6,068,319 | A | * | 5/2000 | O'Brien | 296/37.6 |
| 6,634,691 | B2 | * | 10/2003 | Henderson | 296/37.6 |

(Continued)

OTHER PUBLICATIONS

International Search Report and Written Opinion Mailed Jun. 27, 2012 in the Corresponding PCT/US12/31724.
Examiner's Search History in the Corresponding PCT/US12/31724.
International Preliminary Report on Patentability (IPRP) dated May 6, 2013 from corresponding PCT/US2012/031724, pp. 7.

*Primary Examiner* — Joshua Rodden
(74) *Attorney, Agent, or Firm* — Ohlandt, Greeley, Ruggiero & Perle, L.L.P.

(57) ABSTRACT

A pan guide for use in a food storage apparatus is provided. The pan guide has at least two levels for supporting food storage pans. The levels can be removable. This allows for easy movement of the food pans, to accommodate for temperature changes in the vicinity of the food storage apparatus. Dividers for separating the food pans are also provided, which can connect to the pan guide.

5 Claims, 3 Drawing Sheets

(56) References Cited

U.S. PATENT DOCUMENTS

| | | | | |
|---|---|---|---|---|
| 6,662,732 | B2 * | 12/2003 | Birsel et al. | 108/25 |
| 7,216,500 | B2 * | 5/2007 | Schwichtenberg et al. | 62/258 |
| 7,963,408 | B2 * | 6/2011 | Glover | 211/126.15 |
| 8,020,546 | B1 * | 9/2011 | Bourgeois et al. | 126/25 R |
| 2006/0201177 | A1 * | 9/2006 | Spillner | 62/258 |
| 2009/0013707 | A1 * | 1/2009 | Spillner | 62/258 |
| 2009/0126580 | A1 | 5/2009 | Hartfelder et al. | |
| 2011/0297051 | A1 * | 12/2011 | Martin et al. | 108/25 |

* cited by examiner

FOOD PAN GUIDE

CROSS-REFERENCE TO RELATED APPLICATIONS

The present application claims the benefit of U.S. Provisional Patent Application No. 61/469,561, filed on Mar. 30, 2011.

BACKGROUND OF THE DISCLOSURE

1. Field of the Disclosure

The present disclosure relates to guides used to hold food pans in place for prep tables used in the food service industry. More particularly, the present disclosure relates to a guide having multiple discrete levels at which to place the food pans.

2. Description of the Related Art

In the food service industry, prep tables are used in kitchens to help cooks or other personnel to prepare dishes. The tables will typically comprise a refrigerated compartment, and an open table top. One or more food pans are placed in the open table top, and hold one or more food items. The food in the pans is kept at a food safe temperature by the refrigerated compartment below them.

In currently available systems, there is no way for users of these prep tables to adjust for ambient conditions, which can vary significantly. The height of the pans may need to be changed to lower them deeper into the table top, or elevate them closer to the surface. In current designs, the guides holding the pans must be removed and reattached to allow for different heights, or multiple pan guides must be purchased for each level desired. Changing pan guides can be very difficult and time-consuming, and buying several different guides can be costly. Accordingly, there is a need for a device that alleviates these problems.

SUMMARY OF THE DISCLOSURE

The present disclosure provides a pan guide that has at least two levels for holding food pans. Adapter bars can connect to the levels of the pan guides to customize an opening in a food prep table. Food pans can sit on or be connected to the levels and adapter bars.

Thus, in a first embodiment, the present disclosure provides a pan guide for a food storage apparatus, comprising a planar back plate, a first level connected to the planar back plate, the first level comprising a first flat portion that projects in a direction away from and perpendicular to a face of the planar back plate, and at least one second level connected to the planar back plate, the second level comprising a second flat portion that projects in a direction away from and perpendicular to the face of the planar is back plate, the second flat portion being parallel to the first flat portion.

In another embodiment, the present disclosure provides a food storage apparatus, comprising a top surface with an opening therein and an outer edge surrounding the opening, at least one food pan for storing food products therein, and at least one pan guide connected to the outer edge, wherein the at least one food pan is connected to the at least one pan guide. The pan guide comprises a planar back plate, a first level connected to the planar back plate, the first level comprising a first flat portion that projects in a direction away from and perpendicular to a face of the planar back plate, and at least one second level connected to the planar back plate, the second level comprising a second flat portion that projects in a direction away from and perpendicular to the face of the planar back plate, the second flat portion being parallel to the first flat portion.

DETAILED DESCRIPTION OF THE DISCLOSURE

Referring to the Figures, pan guide 10 is shown. Pan guide 10 can have back plate 12, and two levels 20. The present disclosure also contemplates that there can be more than two levels 20 in guide 10. Levels 20 are perpendicular to back plate 12, and can support food pans, the edges of which rest on levels 20. Thus, pan guide 10 provides several advantages over currently available guides. The ergonomics of pan guide 10 are such that food pans can be placed at different levels without having to remove the guide, or purchase and stock separate guides for each desired level.

In demanding environments, it can be a challenge to maintain food-safe temperatures in the food pans in open top prep tables. Pan guide 10 addressees these challenges. In warmer ambient conditions, the food pans can easily be placed on a lower level to bring them closer to the cooling source. In cooler conditions, the food pans can be placed at a higher level, to provide an ergonomic advantage, yet still maintain NSF7 criteria for food temperatures. As pan guide 10 provides multiple levels 20 for food pan placement, the time and labor associated with removing guides repeatedly when the height of the food pans needs to be adjusted is reduced, as are the inconveniences associated with keeping multiple pan guides in stock.

Figures 1A, 1B, 1C:
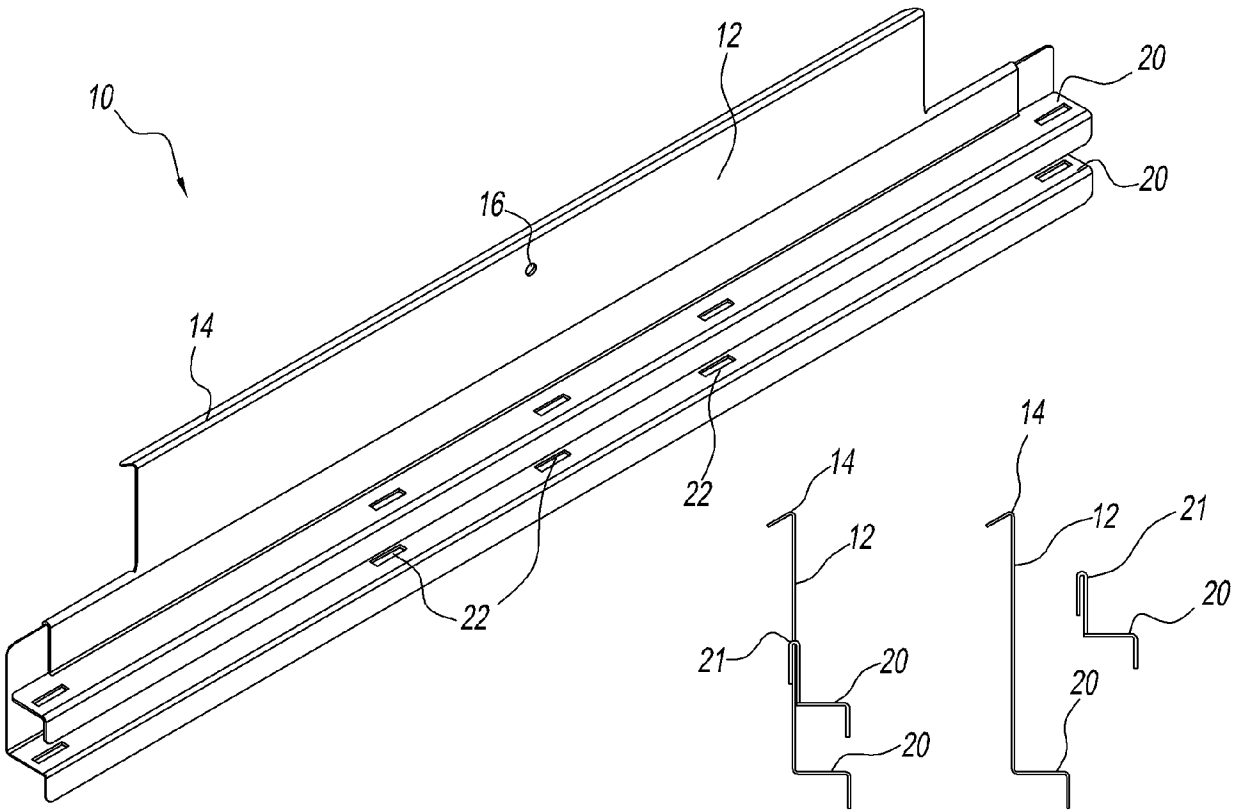
FIG. 1*a* shows the pan guide of the present disclosure.
FIG. 1*b* shows a side view of the pan guide of FIG. 1*a;*
FIG. 1*c* shows a side view of the pan guide of FIG. 1*a* with a level removed.

As shown in FIG. 1, one of levels 20 (in this embodiment the top level) can be removably connected to back plate 12. The removable level 20 can have a hook portion 21 that engages back plate 12 in the manner shown. This assists in the installation of food pans (discussed in greater detail below). If the user wants to place food pans on the lower of levels 20, the upper of levels 20 can simply be removed, without requiring the use of any tools.

Figure 2:
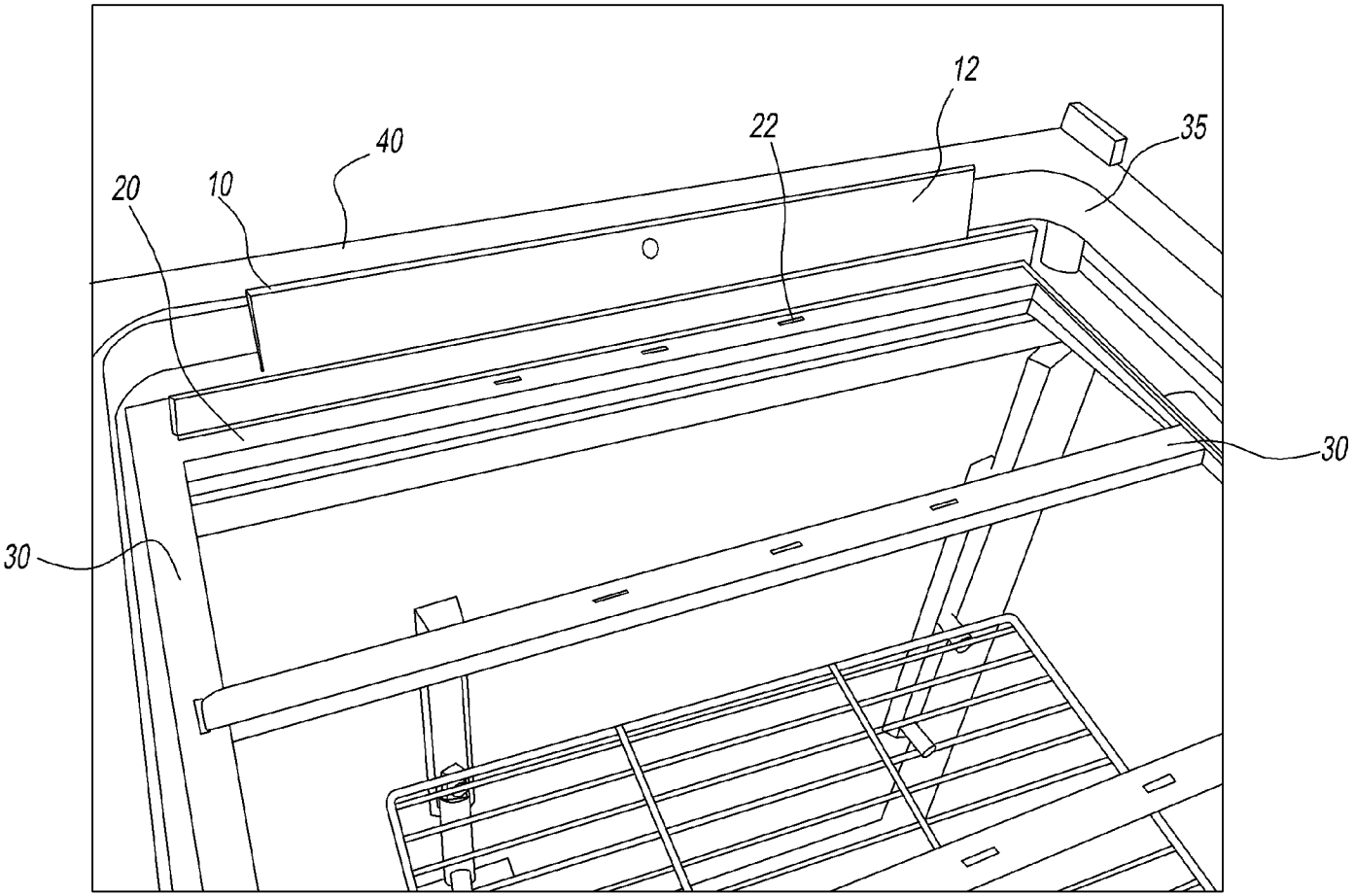
FIG. 2 shows the pan guide of the present disclosure installed in a food prep table.
Figure 3:
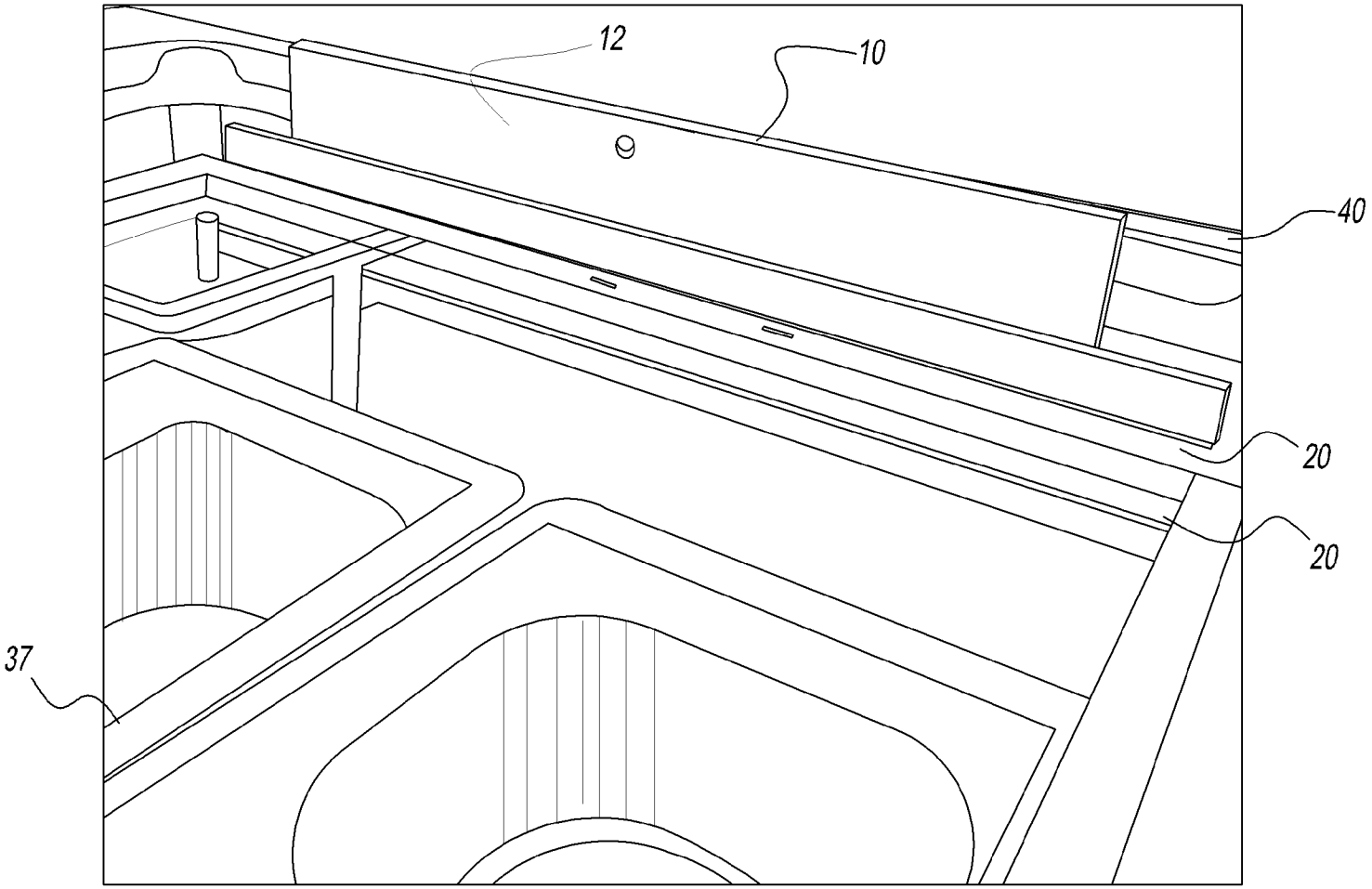
FIG. 3 shows the pan guide of the present disclosure installed in a food prep table, with food pans connected thereto.

Referring to FIGS. 2 and 3, pan guide 10 can be used in table 40 that has opening 35 in a top surface thereof. Each level 20 of pan guide 10 can have a plurality of notches 22 located thereon. As shown in FIGS. 2 and 3, a plurality of adapter bars 30 can be used to section off opening 35 in a variety of different arrangements, to allow for the placement of one or more food pans 37. Adapter bars 30 can have hooks or ends (not shown) that engage notches 22. When the user decides that they want to install pans 37 at a lower or higher level, adapter bars 30 can simply switch to another level 20, without having to remove guide 10. Pans 37 can sit on top of levels 20 and adapter bars 30. Alternatively, pans 37 can more securely connect to levels 20 or adapter bars 30, such as with a snap fit or friction fit. Two pan guides 10 will typically be used in prep table 40.

Pan guide 10 is made out of food-safe material, such as stainless steel. Pans 37 can be either plastic or metal. Pan guide 10 is removable with tools, as per NSF guidelines. Pan guide 10 can be connected to table 40 through mounting hole 16. A top edge of back plate 12 can have top lip 14 that sits on an edge of opening 35, providing a secure connection.

While the present disclosure has been described with reference to one or more particular embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this disclosure.

What is claimed is:

1. A food storage apparatus, comprising:

a top surface with an opening therein and an outer edge surrounding said opening;

a plurality of food pans in said opening, for storing food products therein;

at least one pan guide connected to said outer edge, wherein each of said plurality of food pans is connected to at least one of said at least one pan guide; and at least one divider connected to at least one of said at least one pan guide and said outer edge, for separating said food pans, wherein said pan guide comprises:

a planar back plate;

a first level connected to said planar back plate, said first level comprising a first flat portion that projects in a direction away from and perpendicular to a face of said planar back plate; and at least one second level connected to said planar back plate, said second level comprising a second flat portion that projects in a direction away from and perpendicular to said face of said planar back plate, said second flat portion being parallel to said first flat portion, wherein said face of said planar back plate has a height, and each of said first level and said second level are connected to said planar back plate in spaced relation along said height.

2. The pan guide of claim 1, wherein each of said first flat portion and said second flat portion comprise at least one notch therein.

3. The pan guide of claim 1, wherein said second level comprises at least one hook that engages an edge of said face of said planar back plate, to connect said second level to said planar back plate.

4. The pan guide of claim 1, wherein said at least one second level is removably connected to said planar back plate.

5. The pan guide of claim 1, wherein said at least one second level is permanently connected to said planar back plate.

* * * * *